US006209628B1

(12) United States Patent
Sugimoto et al.

(10) Patent No.: US 6,209,628 B1
(45) Date of Patent: Apr. 3, 2001

(54) HEAT EXCHANGER HAVING SEVERAL HEAT EXCHANGING PORTIONS

(75) Inventors: Tatsuo Sugimoto, Okazaki; Shinobu Suzuki, Kariya; Takaaki Sakane, Nagoya; Yasutoshi Yamanaka, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/489,283

(22) Filed: Jan. 21, 2000

Related U.S. Application Data

(63) Continuation-in-part of application No. 09/039,943, filed on Mar. 16, 1998, now abandoned.

(30) Foreign Application Priority Data

Mar. 17, 1997 (JP) ..... 9-63237

(51) Int. Cl.[7] ..... F28F 13/00
(52) U.S. Cl. ..... 165/140; 165/135; 165/146
(58) Field of Search ..... 165/135, 140, 165/146

(56) References Cited

U.S. PATENT DOCUMENTS 4,693,307 9/1987 Scarselletta .
5,033,540 7/1991 Tategami et al. ..... 165/135
5,311,935 5/1994 Yamamoto et al. .
5,720,341 * 2/1998 Watanabe et al. ..... 165/135

FOREIGN PATENT DOCUMENTS 61-59195 3/1986 (JP) .
6-221787 8/1994 (JP) .

* cited by examiner

*Primary Examiner*—Leonard Leo
(74) *Attorney, Agent, or Firm*—Harness, Dickey & Pierce, PLC

(57) ABSTRACT

A ratio (Nc/Lc), in a condenser core portion, of the number of louvers to a width of a condenser cooling fin, and a ratio (Nr/Lr), in a radiator core portion, of the number of louvers to a width of a radiator cooling fin satisfy that the ratio in one core portion, out of the condenser and the radiator core portions, a required radiation amount of which is larger than that of the other core portion is larger than the ratio in the other core portion. Thus, in the core portion having a small required radiation amount, the number of louvers relative to the width of the cooling fin is small thereby decreasing the heat transfer ratio. However, by this, the air flow resistance in this core portion decreases thereby increasing an air flow amount. Thus, the radiation amount of the core portion of which required radiation amount is large increases.

5 Claims, 16 Drawing Sheets

HEAT EXCHANGER HAVING SEVERAL HEAT EXCHANGING PORTIONS

CROSS-REFERENCE TO RELATED APPLICATION

This application is a CIP application of U.S. application Ser. No. 09/039,943, filed on Mar. 16, 1998, now abandoned and is based on Japanese Patent Application No. 9-63237 filed on Mar. 17, 1997, the contents of which are incorporated herein by reference.

BACKGROUND OF THE INVENTION

1. Field of the Invention

The present invention relates to a heat exchanger in which different core portions are integrated with each other, and more particularly the present invention relates to a heat exchanger which can be effectively applied to a radiator of an automotive engine and a condenser of an automotive air conditioning apparatus.

2. Description of Related Art

Conventionally, an automotive air conditioning apparatus is assembled into a vehicle at a car dealer or the like after the vehicle has been completed. Recently, however, the automotive air conditioning apparatus is generally installed in the vehicle during vehicle assembling process. Therefore the automotive air conditioning apparatus is assembled with automotive parts in the assembling process of the vehicle at the manufacturing plant.

A heat exchanger in which different core portions such as a radiator and a condenser are integrated is disclosed in Japanese Patent Publication No. 3-177795. In this heat exchanger, cooling fins of first core portion and second core portion are integrated with each other. These cooling fins are connected to each oval flat tube of the first and second core portions by brazing.

In the cooling fin, a plurality of slits are formed at the center portion between the first and second core portions for interrupting a heat transmission from a high temperature side core portion (for example, radiator core portion) to a low temperature side core portion (for example, condenser core portion).

The required heat exchanging abilities of the first core portion (condenser core portion) and the second core portion (radiator core portion) varies in accordance with the difference of engine type or vehicle type despite the required constitutions of the heat exchanger are the same. When the automotive heat exchanger is constructed by some single heat exchangers, the required heat exchanging abilities thereof are set by tuning fin pitches of the cooling fins respectively in accordance with the engine type or vehicle type.

However, in the heat exchanger in which different core portions are integrated and cooling fins of first core portion and second core portion are integrated with each other, each fin pitch cannot be designed independently respectively. Therefore, the above-described method of setting the fin pitches in the first and second core potions respectively cannot be applied to this type heat exchanger.

SUMMARY OF THE INVENTION

In view of the foregoing problems, it is an object of the present invention to provide a heat exchanger in which different core portions and cooling fins thereof are integrated with each other, while setting the required heat exchanging abilities of each core portion independently respectively.

According to a first aspect of the present invention, a ratio, in a first core portion, of the number of louvers to a width of a first cooling fin, and a ratio, in a second core portion, of the number of louvers to a width of a second cooling fin are set to be in such a manner that the ratio in one core portion, out of said first and second core portion, the required radiation amount of which is larger than that of the other core portion is larger than the ratio in the other core portion.

Thus, in the core portion having a small required radiation amount, the number of louvers relative to the width of the cooling fin is small thereby decreasing the heat transfer ratio. However, the pressure loss in this core portion decreases thereby increasing the amount of an external fluid. Thus, the radiation amount of the core portion having a large required radiation amount increases.

According to a second aspect of the present invention, in one core portion, out of the first and second core portions, the required radiation amount of which is smaller than that of the other core portion, a width of the cooling fin in an external fluid flow direction is shorter than a width of a tube in its cross sectionally longitudinal direction. Further, a ratio, in the first core portion, of the number of louvers to the width of a first tube, and a ratio, in the second core portion, of the number louvers to the width of a second tube are set to be in such a manner that the ratio in one core portion, out of the first and second core portions, the required radiation amount of which is smaller than that of the other core portion is smaller than the ratio in the other core portion.

Thus, in the core portion having a small required radiation amount, the width of the cooling fin and the number of louvers relative to the width of the tube in its cross sectionally longitudinal direction are small thereby decreasing the heat transfer ratio. However, by this, the pressure loss in the core portion decreases thereby increasing the amount of an external fluid. Thus, the radiation amount of the core portion having a large required radiation amount increases.

According to a third aspect of the present invention, the length of the louver in one core portion, out of the first and second core portions, the required radiation amount of which is smaller than that of the other core portion is shorter than the length of the louver in the other core portion.

Thus, in the core portion having a small required radiation amount, the length of the louver is short thereby decreasing the heat transfer ratio. However, by this, the pressure loss in the core portion decreases thereby increasing the flow amount of the external fluid. Thus, the radiation amount of the core portion having a large required radiation amount increases.

According to a fourth aspect of the present invention, a tilt angle of the louver in one core portion, out of the first and second core portion, the required radiation amount of which is smaller than that of the other core portion is smaller than the tilt angle of the louver in the other core portion.

Thus, in the core portion having a small required radiation amount, the tilt angle of the louver is small thereby decreasing the heat transfer ratio. However, by this, the pressure loss in the core portion decreases thereby increasing the flow amount of the external fluid. Thus, the radiation amount of the core portion having a large required radiation amount increases.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

(First Embodiment)

Figure 1:
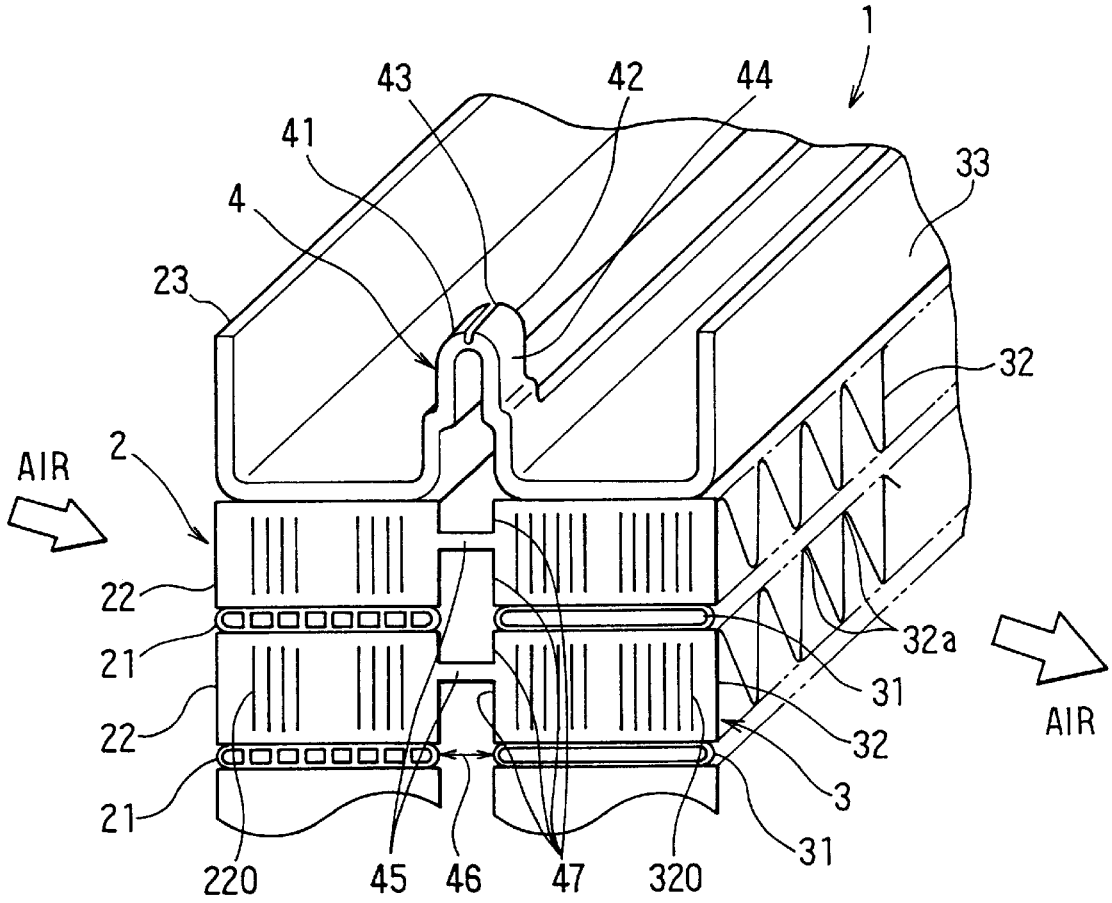
FIG. 1 is a perspective view showing a core portion of a heat exchanger according to the first embodiment of the present invention.
Figure 2:
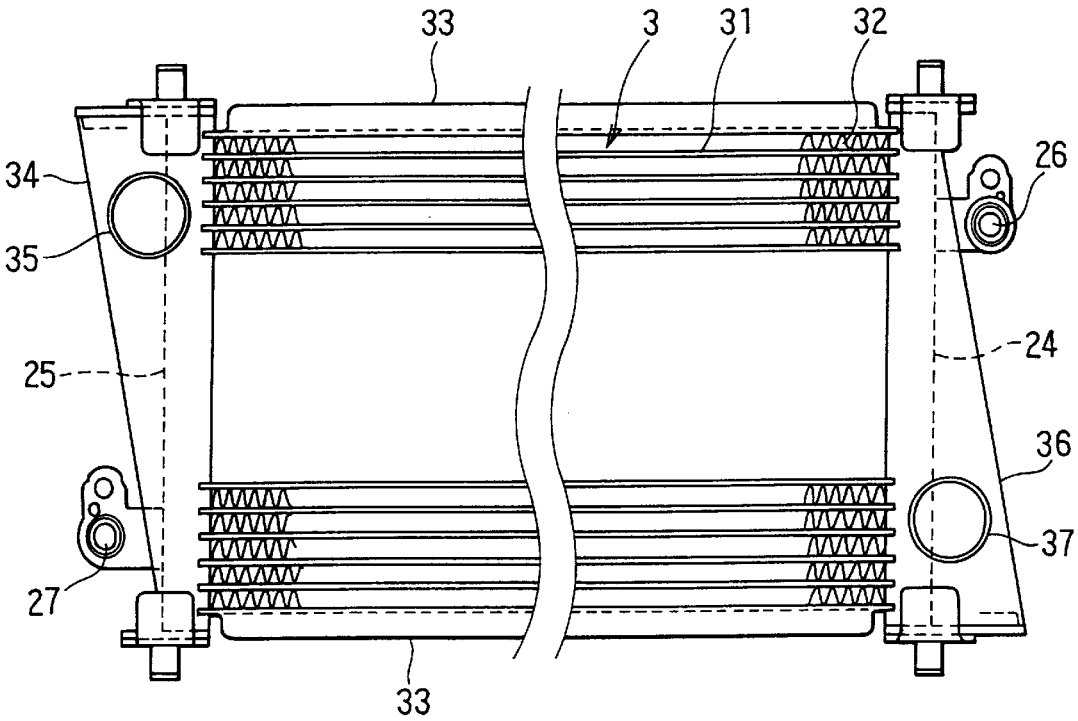
FIG. 2 is a front view showing a core portion of a heat exchanger according to the first embodiment.

In an automotive heat exchanger 1 shown in FIGS. 1,2, a condenser core portion 2 of an automotive air conditioning apparatus is used as a first core portion, and a radiator core portion 3 for cooling an engine is used as a second core portion. Generally, because the temperature of refrigerant flowing through the condenser core portion 2 is lower than that of engine cooling water flowing through the radiator core portion 3, the condenser core portion 2 is disposed at the upstream air side of the radiator core portion 3 in air flow direction and the two core portions 2, 3 are disposed in series in the air flow direction at the front-most portion of an engine compartment. The structure of the heat exchanger of the first embodiment is hereinafter described with reference to FIGS. 1 through 5.

FIG. 1 is a partial enlarged cross-sectional view of a heat exchanger 1 of the present invention. As shown in FIG. 1, a condenser core portion 2 and a radiator core portion 3 are disposed in series in the air flow direction so as to form predetermined clearances 46 between each pair of a condenser tube 21 and a radiator tube 31 described later to interrupt heat transmission.

The condenser core portion 2 includes flat shaped condenser tubes 21 in which a plural refrigerant passages are formed, and corrugated (wave-shaped) cooling fins 22 in which a plurality of folded portions 22*a* brazed to the condenser tube 21 are formed.

The radiator core portion 3 has a similar structure with the condenser core portion 2. The radiator core portion 3 includes the radiator tubes 31, in which a single coolant passage is formed, disposed in parallel with the condenser tubes 21 and radiator cooling fins 32. The tubes 21 and 31 and the cooling fins 22, 32 are alternately laminated and are brazed to each other. A plurality of louvers 220 and 320 are formed in the two cooling fins 22, 32 to facilitate heat exchange. The two cooling fins 22, 32 and a plurality of connecting portions 45 are integrally formed with the louvers 220, 320 by a roller forming method or the like.

The connecting portions 45 are formed between the two cooling fins 22, 32 for connecting the two cooling fins 22, 32. At both sides of the connecting portion 45, adiabatic slits 47 are provided for interrupting heat transmission from the radiator core portion 3 to the condenser core portion 2. The width of the connecting portion 45 is set to be smaller enough than the height of the cooling fins 22, 32 (the distance between a pair of adjacent flat tubes 21, 31) to suppress the heat transmission from the radiator core portion 3 to the condenser core portion 2.

Side plates 23, 33 are reinforcement member of the two heat exchanging core portions 2, 3. The side plates 23, 33 are respectively disposed in upper and lower end portions of the two heat exchanging core portions 2, 3 as shown in FIG. 2. As shown in FIG. 1, the side plates 23, 33 are integrally formed from a sheet of aluminum plate to a general U-shape in cross section. Connecting portions 4 for connecting the side plate 23 and the side plate 33 are formed in two end portions of the longitudinal direction of the two side plates 23, 33. A Z-shaped bent portion 41 of the side plate 23 and a Z-shaped bent portion 42 of the side plate 33 are connected to each other at a top end portion 43 so that the connecting portion 4 is formed. The width of the connecting portion 4 is set to be small enough as compared with the dimension of the side plate 23 or 33 in the longitudinal direction to suppress the heat transmission. Further, a recess portion is formed in the top end portion 43 of the connecting portion 4 to reduce the thickness of the plate wall of the connecting portion 4.

Figure 3:
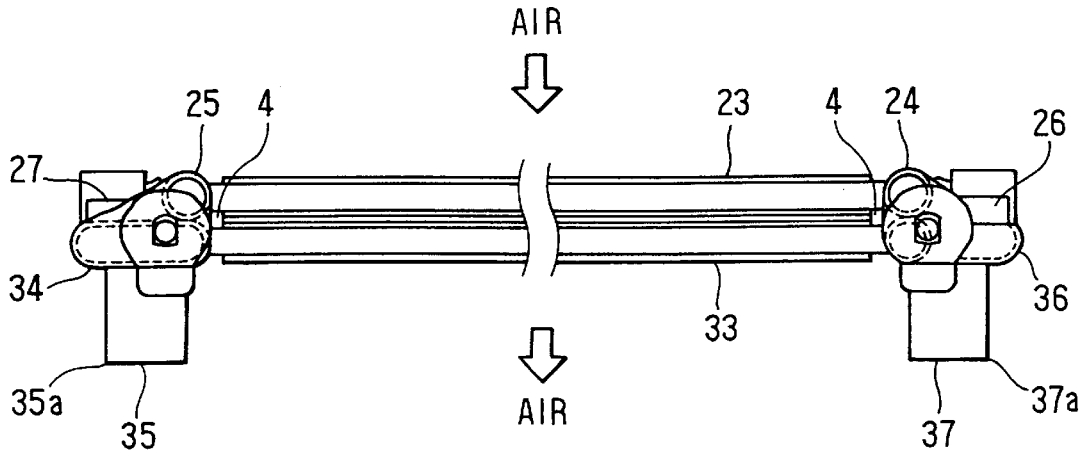
FIG. 3 is a plan view showing a core portion of a heat exchanger according to the first embodiment.
Figure 4:
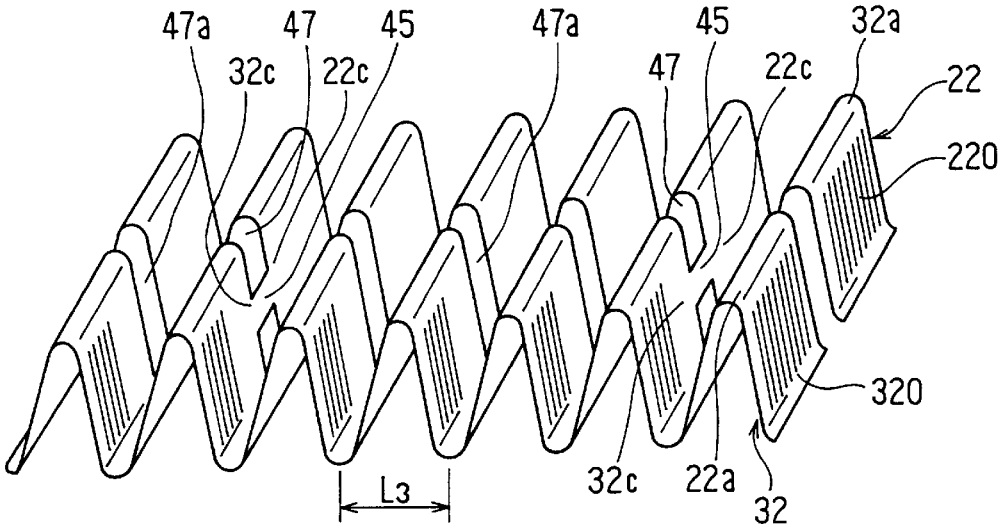
FIG. 4 is a perspective view showing a shape of the cooling fin.
Figure 5A:
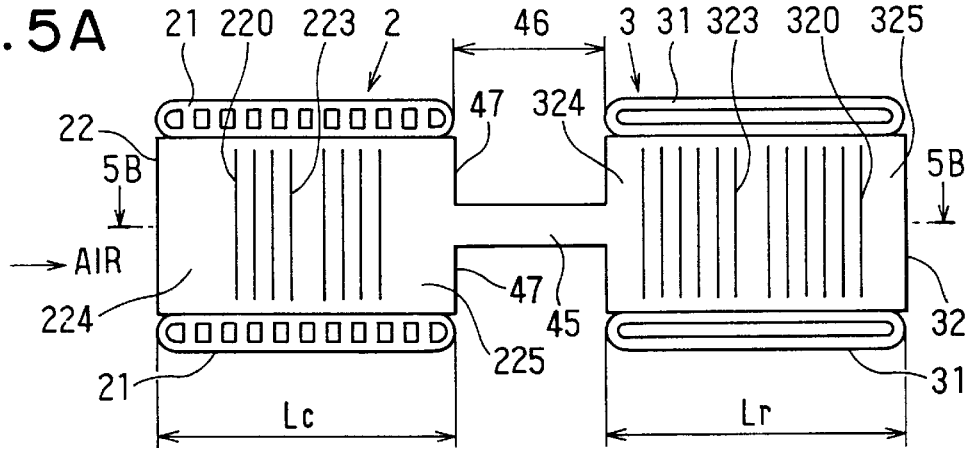
FIG. 5A is a plan view showing tubes and cooling fins according to the first embodiment.
Figure 5B:
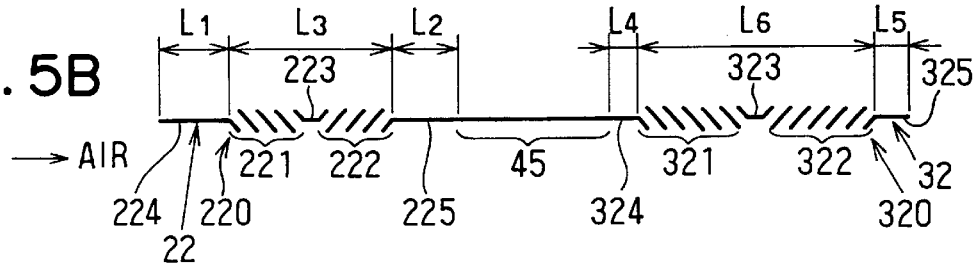
FIG. 5B is a cross sectional view taken along line 5B—5B in FIG. 5A.

Further, as shown in FIG. 2, a first header tank 34 for distributing cooling water to each radiator tube 31 is disposed at an end (left end) side of the radiator core portion 3. The front shape of first header tank 34 is nearly a triangular, the cross-sectional shape is ellipsoid as shown in FIG. 3. An inlet 35 of cooling water flowing to the radiator is formed at an upper side of the first header tank 34 having a nearly triangular shape. Further, a pipe 35*a* for connecting a pipe (not shown) of cooling water is brazed to the inlet 35.

Further, a second header tank 36 for receiving the cooling water having been heat-exchanged is disposed in an opposite end (right end) of the first header tank 34. The second header tank 36 has a similar shape with the first header tank 34. As shown in FIG. 2, the second header tank 36 and the first header tank 34 are point-symmetrical with reference to the center of the radiator core portion 3. Further, an outlet 37 for discharging the cooling water is formed at the bottom side of the second header tank 36. With the tubes and the cooling fins and the like, a pipe 37*a* for connecting the pipe (not shown) of cooling water is brazed to the outlet 37.

A first header tank 24 is disposed at an end side of the condenser core portion 2 for distributing the refrigerant into each condenser tube 21, and the body of the first header tank 24 is cylindrically formed as shown in FIG. 3. The first header tank 24 of the condenser is disposed to have a predetermined clearance with the second header tank 36 of the radiator. Further, a joint 26*a* for connecting a refrigerant pipe (not shown) is brazed to the body of the first header tank 24, and an inlet 26 of refrigerant is formed in the joint 26*a*.

Further, as shown in FIG. 3, a second header tank 25 of the condenser for receiving the refrigerant having been heat-exchanged is disposed at an opposite end of the first header tank 24 of the condenser core portion 2. The second header tank 25 is disposed to have a predetermined clearance with the first header tank 34 of the radiator. The body of the second header tank 25 is cylindrically formed. Further, as shown in FIG. 2, a joint 27*a* for connecting a refrigerant pipe (not shown) is brazed to the body of the second header tank 25. An outlet 27 of refrigerant is formed in the joint 27*a*.

Next, the condenser cooling fin 22 and the radiator cooling fin 32 will be described.

The width Lc of the condenser cooling fin 22 and the width Lr of the radiator cooling fin 32 have the same length as the width of the tubes 21, 31 in the cross sectional longitudinal direction thereof. Here, the widths Lc, Lr are the dimension of the cooling fins 22, 32 along the cross sectionally longitudinal direction of the tubes 21, 31 (air flow direction).

The louver 220 of the condenser cooling fin 22 is constructed by a first louver group 221, a second louver group 222, and a turning louver 223 arranged between both louver groups 221, 222. The turning louver 223 turns the air flow. The first louver group 221 and the second louver group 222 tilt toward the opposite side to each other.

Similarly, a first louver group 321, a second louver group 322, and a turning louver 323 are provided in the radiator cooling fin 32.

The numbers of both louvers 220, 320 are set as follows to improve the heat transmitting ability (heat transmitting amount). In the condenser cooling fin 22, each first and second louver groups 221, 222 has three louvers 220. In the radiator cooling fin 32, each first and second louver groups 321, 322 has five louvers 320.

That is, the number Nc of the louvers 220 in the condenser cooling fin 22 is six (Nc=6), and the number Nr of the louvers 320 in the radiator cooling fin 32 is ten (Nr=10).

Accordingly, the ratio of the Nc and Lc in the condenser cooling fin 22 (Nc/Lc) and the ratio of the Nr and Lr in the radiator cooling fin 32 (Nr/Lr) satisfy the following relation:

$$(Nc/Lc)<(Nr/Lr).$$

Here, the condenser cooling fin 22 has six louvers although ten louvers can be provided thereon if desired. Therefore, the area of air introducing portions 224, 225 provided in front and rear of the louvers 220 can be wide relative to the area where the louvers 220 are formed.

Accordingly, the ratio of the sum of the lengths of the air introducing portions 224, 225 in the air flow direction (L1+L2) to the length of the space where the louvers 220 are formed in the air flow direction L3, [(L1+L2)/L3], and the ratio of the sum of the lengths of the air introducing portions 324, 325 in the air flow direction (L4+L5) to the length of the space where the louvers 320 are formed in the air flow direction L6, [(L4+L5)/L6], satisfy the following relation:

$$[(L1+L2)/L3]>[(L4+L5)/L6].$$

Next, an operation of the above-described structure will be explained.

When a cooling fan (not illustrated) which is disposed at the air downstream side of the radiator core portion 3 operates, the cooling air passes through the condenser core portion 2 and the radiator core portion 3, as shown in FIGS. 1 and 2.

At the same time, a gas phase refrigerant flowing out of a compressor flows into the first header tank 24 through the refrigerant inlet 26. The gas phase refrigerant flows in the condenser tubes 21 from the right side to the left side in FIGS. 2 and 3 while being heat exchanged with the cooling air to be condensed. The condensed liquid phase refrigerant is collected in the second header tank 25 and flows out of the condenser core portion 2 through the refrigerant outlet 27.

A hot engine coolant flows from an engine into the first header tank 34 through the engine coolant inlet 35. The engine coolant flows in the radiator tube 31 from the left side to the right side in FIGS. 2 and 3 while being heat exchanged with the cooling air to be cooled. The cooled engine coolant is collected in the second header tank 36 and flows out of the radiator core portion 3 through the engine coolant outlet 37.

The heat exchanging abilities of the condenser core portion 2 and the radiator core portion 3, if the constitutions thereof are the same, depend on the heat transmitting ratio and the air flow resistance thereof. The heat transmitting ratio and the air flow resistance decrease in accordance with a decrease in the number of the louvers 220, 320.

According to the first embodiment, in the condenser cooling fin 22, six louvers are provided although ten louvers can be provided thereon if desired. While, in the radiator cooling fin 32, ten louvers are provided by using the most of the space thereof.

Therefore, the heat transfer ratio in the condenser core potion 2 decreases in accordance with the decreasing the number of the louvers 220. Thus, the heat transmitting ability of the condenser core portion 2 decreases. However, the air flow resistance in the condenser core portion 2 decreases thereby increasing the amount of the cooling air passing through the radiator core portion 3. Thus, the heat transmitting ability of the radiator core portion 3 increases.

(Second Embodiment)

Figure 6A:
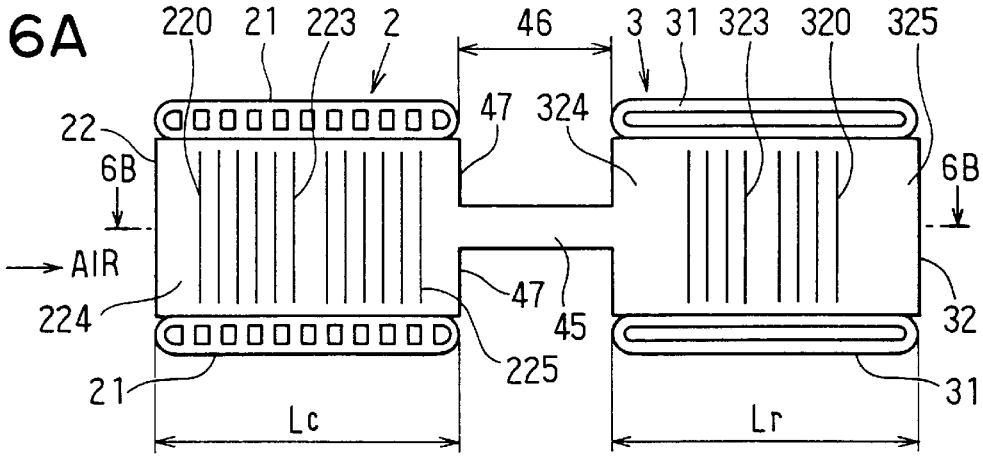
FIG. 6A is a plan view showing tubes and cooling fins according to the second embodiment.
Figure 6B:
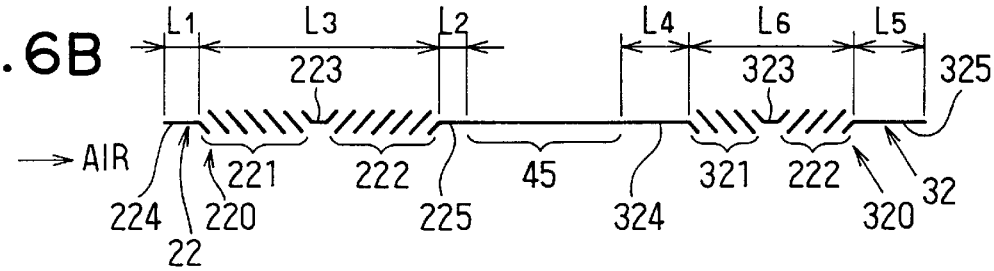
FIG. 6B is a cross sectional view taken along line 6B—6B in FIG. 6A.

According to the second embodiment, as shown in FIGS. 6A, 6B, in the condenser cooling fin 22, ten louvers 220 are provided by making the most of the space thereof. While, in the radiator cooling fin 32, six louvers 320 are provided although ten louvers can be provided thereon if desired. That is, the relation: (Nc/Lc)>(Nr/Lr) is satisfied. Thereby, the radiation amount in the radiator core portion 3 decreases, while the radiation amount in the condenser core portion 2 increases with the air flow amount increasing.

Figure 7:
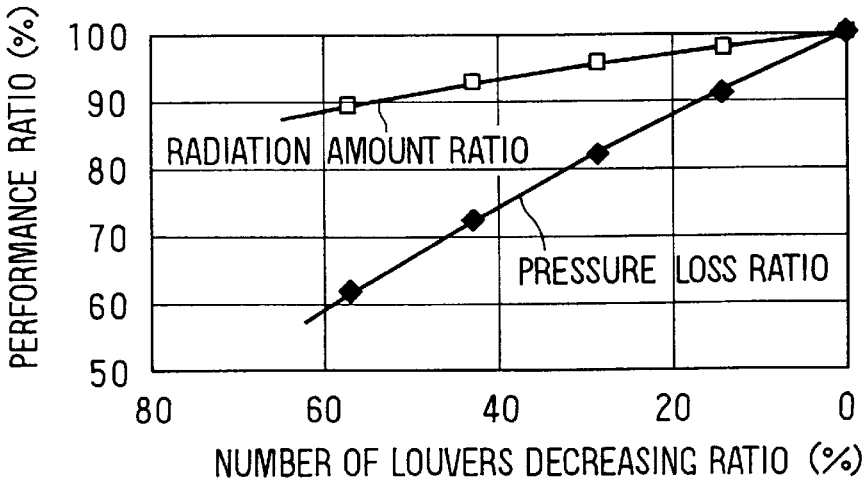
FIG. 7 is a graph showing a relationship between a number of louvers decreasing ratio and a performance ratio.

FIG. 7 shows the relations between the number of louvers decreasing ratio and the performance ratios of the core portions 2, 3 under the condition that air flow speed of the cooling air is constant. Here, the number of louvers decreasing ratio is defined as a ratio of the number of louvers decreased relative to the number of louvers which can be provided within the predetermined fin width Lc, Lr. For example, in the condenser cooling fin 22 shown in FIG. 5A, six louvers is provided although ten louvers can be provided, thus the number of louvers decreasing ratio is 40%. Similarly, in the radiator cooling fin 32 shown in FIG. 6A, the number of louvers decreasing ratio is 40%.

As is understood from FIG. 7, when the number of louvers decreasing ratio is set to 50% in one of the condenser core portion 2 and the radiator core portion 3, the radiation amount in this core portion decreases by about 10% and the pressure loss therein decreases by about 30%. In this way, as the pressure loss decreases in one core portion, the flow amount of the air passing through these core portions increases thereby increasing the radiation amount in the other core portion by about 5%.

Further, as is understood from FIG. 7, it is necessary to set the number of louvers decreasing ratio to 30% or more for decreasing the pressure loss by about 20%.

Figure 27:
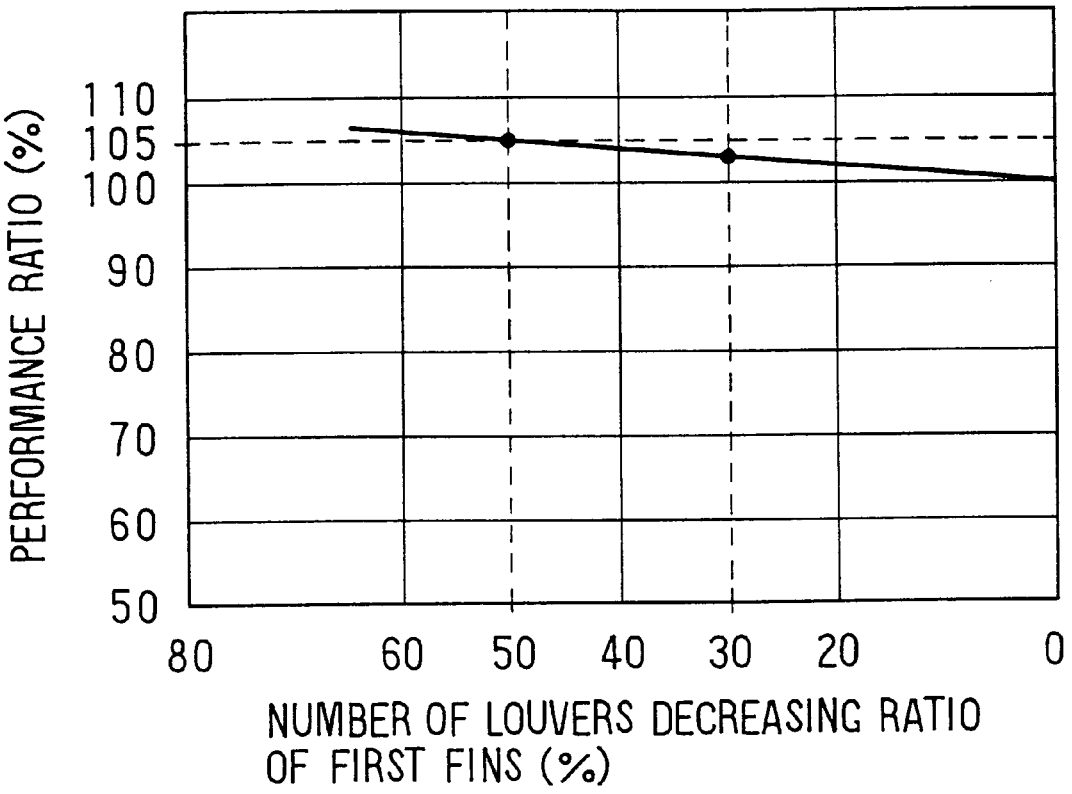
FIG. 27 is a graph showing a relationship between a number of louvers decreasing ratio of first cooling fin and a performance ratio of second core portion.

FIG. 27 shows a relationship between a number of louvers decreasing ratio of the first core portion which is required smaller radiation amount and a performance ratio of the second core portion which is required larger radiation amount. It is necessary to set the number of louvers decreasing ratio of the first core larger than 30% for significant increasing the radiation amount of the second core by about 3%. Preferably, the first core portion is the condenser with decreased number of louvers. The second portion is the radiator with the full number of louvers which can be provided within the fin width. The number of louvers in the first core as the condenser is decreased by 30% or more relative to the number of louvers in the second core as the radiator. Therefore, the density of the louvers on the first fin area is less than the density of the louvers on the second fin area.

(Third Embodiment)

Figure 8A:
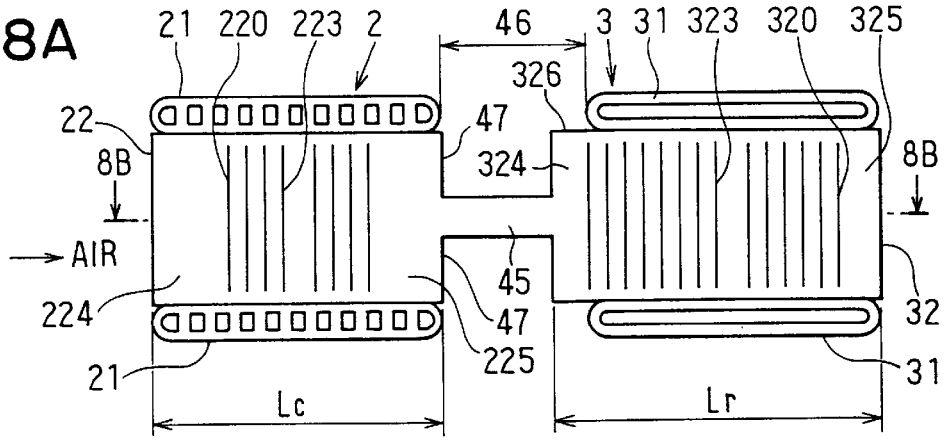
FIG. 8A is a plan view showing tubes and cooling fins according to the third embodiment.
Figure 8B:
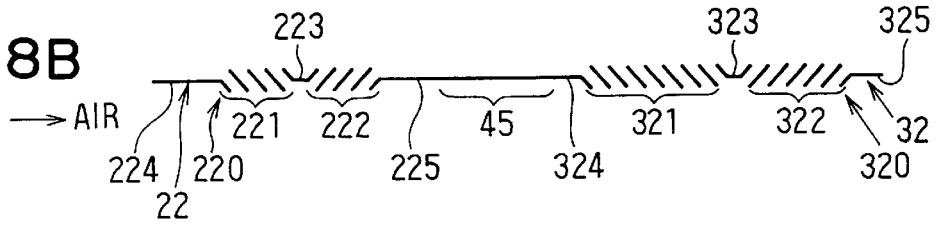
FIG. 8B is a cross sectional view taken along line 8B—8B in FIG. 8A.

According to the third embodiment, as shown in FIGS. 8A, 8B, a projection portion 326 is formed at the air upstream side end (the end facing the condenser core portion 2) of the radiator cooling fin 32. This projection portion 326 protrudes from the end of the radiator tube 31 toward the air upstream side. Thereby, the number of louvers Nr in the radiator cooling fin 32 is increased more than that in the first embodiment.

For example, as shown in FIGS. 8A, 8B, the radiator cooling fin 32 has twelve louvers 320. Thus, a radiation amount difference between in the condenser core portion 2 and in the radiator core portion 3 is expanded more than in the first embodiment.

(Fourth Embodiment)

Figure 9A:
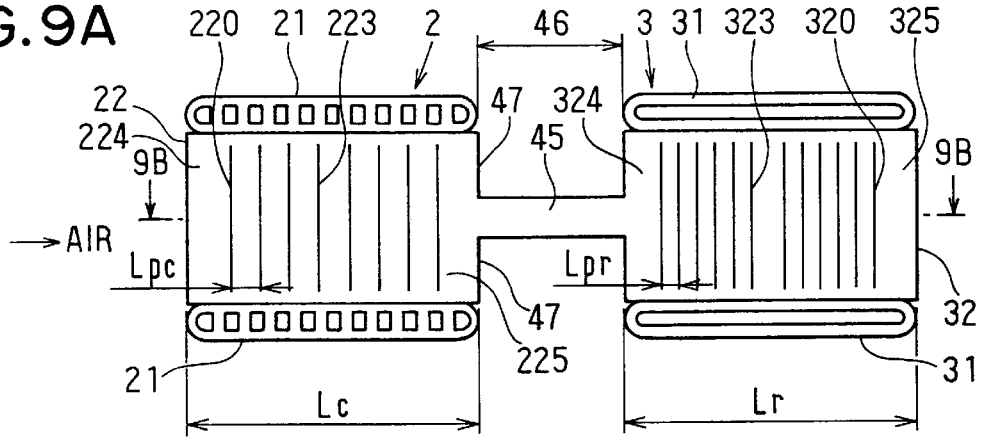
FIG. 9A is a plan view showing tubes and cooling fins according to the fourth embodiment.
Figure 9B:
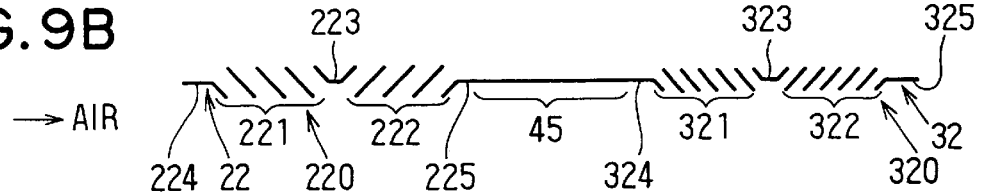
FIG. 9B is a cross sectional view taken along line 9B—9B in FIG. 9A.

According to the forth embodiment, as described in the first embodiment, the condenser cooling fin 22 has six louvers in spite of ten louvers can be provided thereon if making the most of the space thereof. In the fourth embodiment, as shown in FIGS. 9A, 9B, the louver pitch Lpc of the louver 220 is set to be wider than the louver pitch Lpr of the louver 320. Here, the louver pitch Lpc is defined as a distance between a pair of adjacent louvers 220, 320. This distance is same as the length of each louver 220, 320 in the air flow direction.

In this way, the louver pitch in the condenser cooling fin 22 is set to be wider than in the first embodiment. Thus, the length of the air introducing portions 224, 225 (L1+L2) can be decreased more than in the first embodiment.

In the first embodiment, the area L3 where the louvers 220 are formed is partial to the center portion of the condenser cooling fin 22. Thus, the air flowing along the tilted surface of the louvers 220 is collected in the center portion of the cooling fin 22, and the reduction ratio of the heat transmitting ratio can be made remarkable. However, in the fourth embodiment, as the louver pitch Lpc is set to be larger than in the first embodiment, the air flowing along the tilted surface of the louvers 220 is spread entirely. Thus, the reduction ratio of the heat transmitting ratio can be decreased.

(Fifth Embodiment)

Figure 10A:
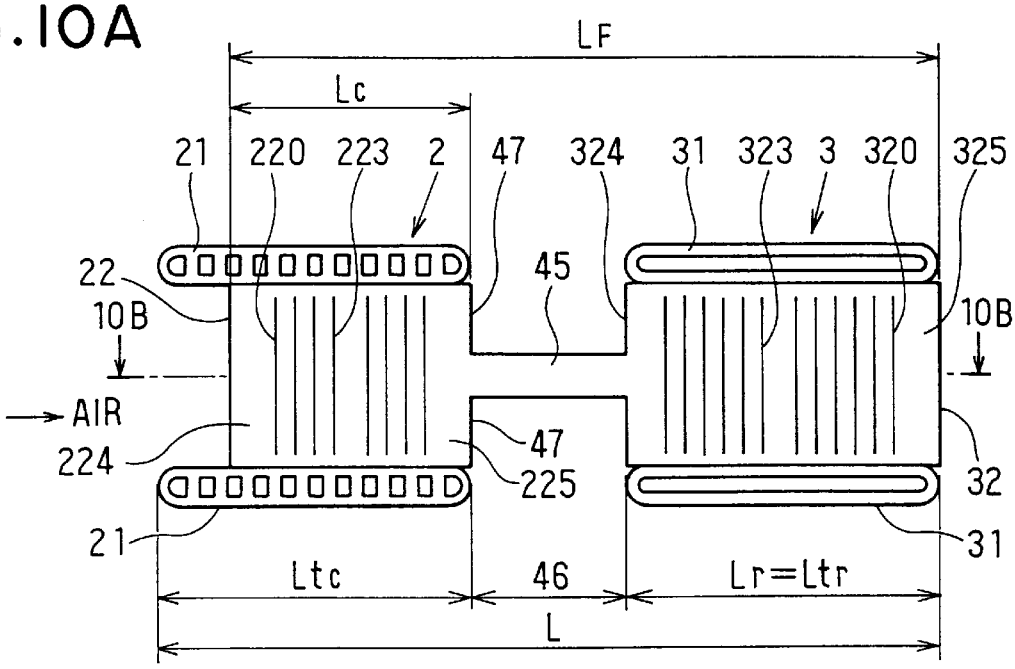
FIG. 10A is a plan view showing tubes and cooling fins according to the fourth embodiment.
Figure 10B:
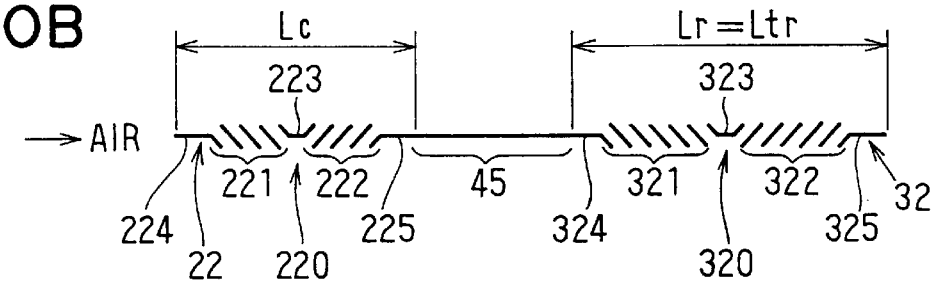
FIG. 10B is a cross sectional view taken along line 10B—10B in FIG. 10A.

According to the fifth embodiment, as shown in FIGS. 10A, 10B, the fin width Lc of the condenser cooling fin 22 is smaller than the width Ltc of the condenser oval flat tube 21. While, in the radiator cooling fin 32, the fin width Lr is same as the width Ltr of the radiator oval flat tube 31. Here, the width Ltc of the condenser tube 21 is same as the width Ltr of the radiator tube 31.

Accordingly, the ratio of the number of louvers 220 Nc (in FIGS. 10A, 10B, Nc=6) to the condenser tube width Ltc (Nc/Ltc) and the ratio of the number of louvers 320 Nr (in FIGS. 10A, 10B, Nr=10) to the radiator tube width Ltr (Nr/Ltr) satisfy the following relation:

(Nc/Ltc)<(Nr/Ltr).

Here, in FIGS. 10A, 10B, $L_F$ denotes a width of an entire fin constructed by the condenser cooling fin 22 and the radiator cooling fin 32, and L denotes the distance between both ends of both oval flat tubes 21, 31 (the width of the heat exchanger).

According to the fifth embodiment, because in the condenser core portion 2, the fin width Lc relative to the tube width Ltc is small in comparison with in the radiator core portion 3, the radiation area in the condenser core portion 2 decreases thereby decreasing the radiation amount. However, by decreasing the fin width Lc and the number Nc of the louvers 220 decreases, the air flow resistance in the condenser core portion 2 decreases thereby increasing the air flow amount passing through these heat exchanging core portions 2, 3. Consequently, the radiation amount in the radiator core portion 3 increases.

(Sixth Embodiment)

Figure 11A:
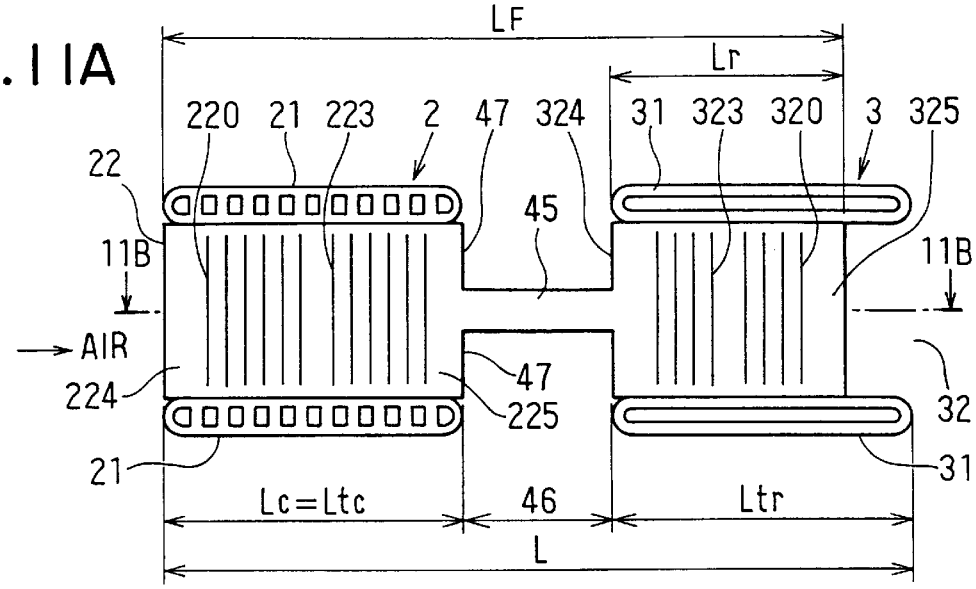
FIG. 11A is a plan view showing tubes and cooling fins according to the sixth embodiment.
Figure 11B:
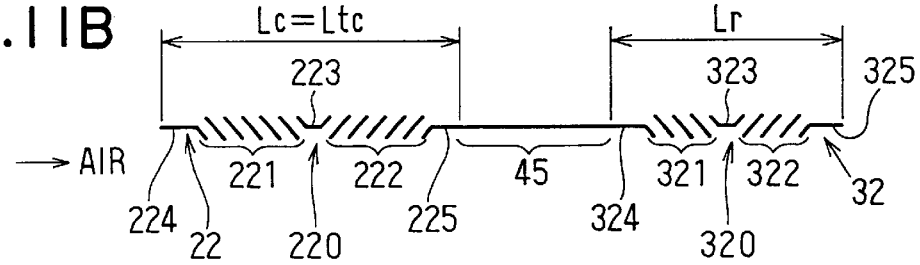
FIG. 11B is a cross sectional view taken along line 11B—11B in FIG. 11A.

According to the sixth embodiment, as shown in FIGS. 11A, 11B, the fin width Lr of the radiator cooling fin 32 is smaller than the width Ltr of the radiator oval flat tube 31. While, in the condenser cooling fin 22, the fin width Lc is same as the width Ltc of the condenser oval flat tube 21. Here, the width Ltc of the condenser tube 21 is same as the width Ltr of the radiator tube 31.

Accordingly, the ratio of the number Nc of louvers 220 (in FIGS. 11A, 11B, Nc=10) to the condenser tube width Ltc (Nc/Ltc) and the ratio of the number Nr of louvers 320 (in FIGS. 11A, 11B, Nr=6) to the radiator tube width Ltr [Nr/Ltr] satisfy the following relation:

(Nc/Ltc)>(Nr/Ltr).

Thus, the radiation amount in the radiator core portion 3 decreases. However, the air flow resistance in the radiator core portion 3 decreases thereby increasing the air flow amount passing through these heat exchanging core portions 2, 3. Consequently, the radiation amount in the condenser core portion 2 increases.

Figure 12:
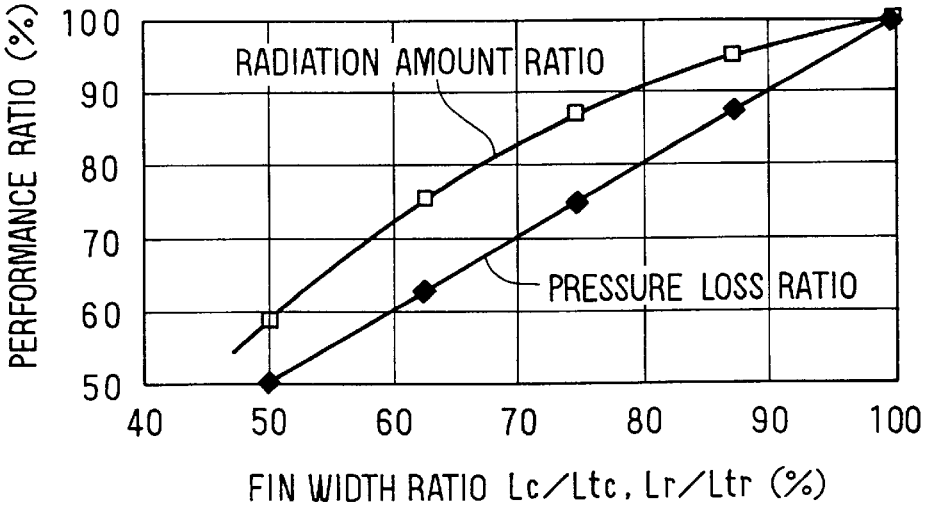
FIG. 12 is a graph showing a relationship between a fin width ratio and a performance ratio.

FIG. 12 is a graph showing the experimented results based on the fifth and the sixth embodiments. The graph shows relations between the ratio of the fin width Lc, Lr to the tube width Ltc, Ltr (Lc/Ltc, Lr/Ltr) and the radiation performance ratio of the condenser core portion 2 and the radiator core portion 3. Here, the experimented results are under the condition that the air flow speed is constant.

As is understood from FIG. 12, when the fin width Lc or Lr is set to 80% of the tube widths Ltc, Ltr in one of the condenser core portion 2 and the radiator core portion 3, the radiation amount in this core portion decreases by about 10% and the pressure loss therein decreases by about 20%. In this way, as the pressure loss decreases in one core portion, the flow amount of the air passing through these core portions increases thereby increasing the radiation amount in the other core portion by about 3%. Further, as is understood from FIG. 12, it is necessary to set the fin width Lc, Lr to 80% or less of the tube width Ltc, Ltr.

(Seventh Embodiment)

Figure 13A:
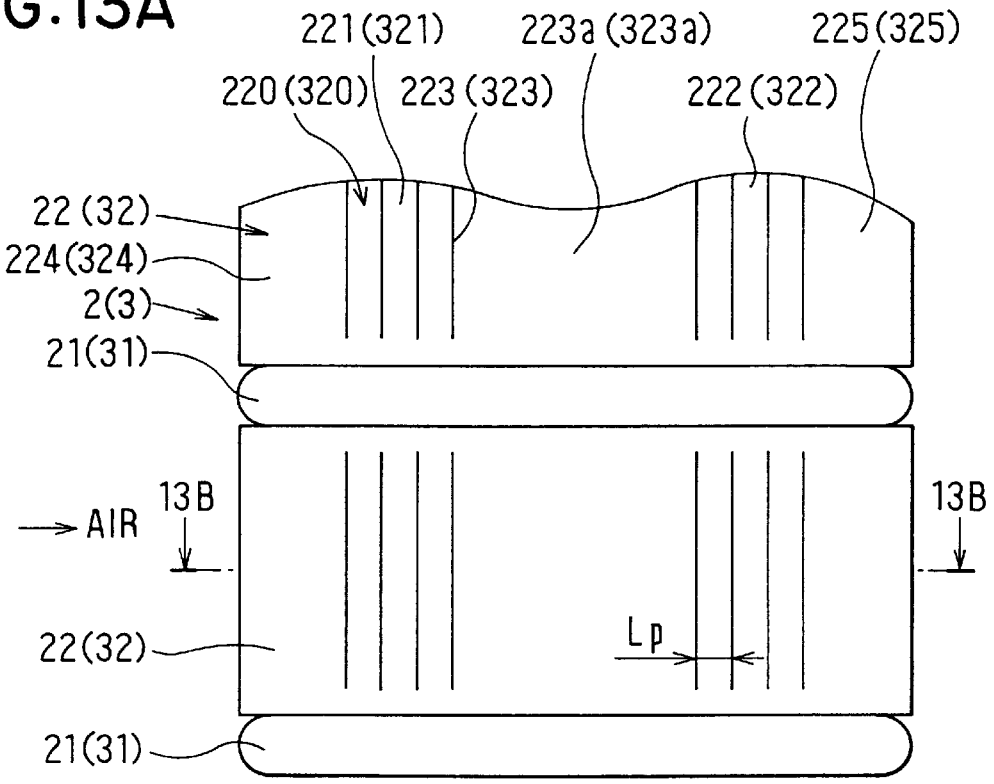
FIG. 13A is a plan view showing tubes and cooling fins according to the seventh embodiment.
Figure 13B:
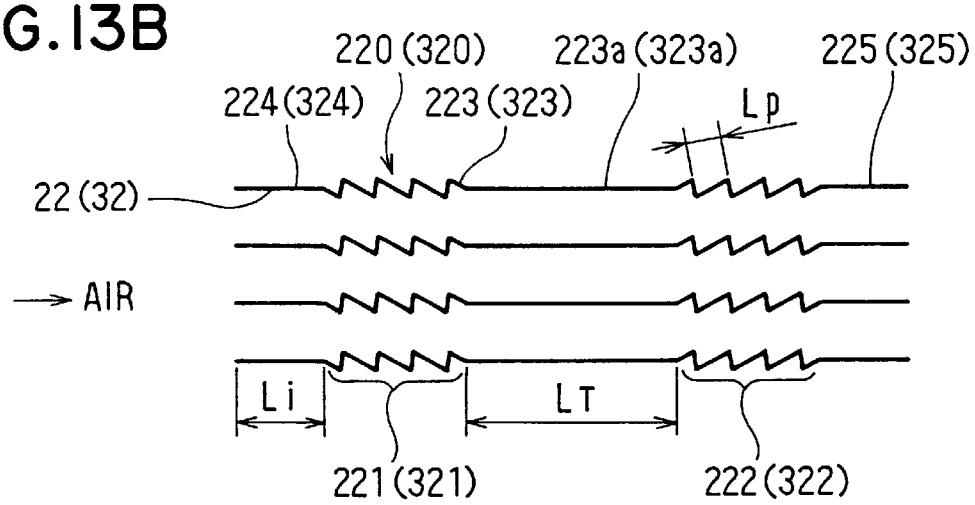
FIG. 13B is a cross sectional view taken along line 13B—13B in FIG. 13A.

According to the seventh embodiment, as shown in FIGS. 13A, 13B, the length $L_T$ of the flat turning surface 223*a*, 323*a* of the turning louver 223, 323 is set to be three times or more as the louver pitch Lp. Here, for example, the length of the flat turning surface 223*a*, 323*a* is set to be about 5.5 times as the louver pitch Lp. The object of the seventh embodiment is to suppress the reduction of heat transfer ratio in the cooling fin 22, 32.

Figure 14A:
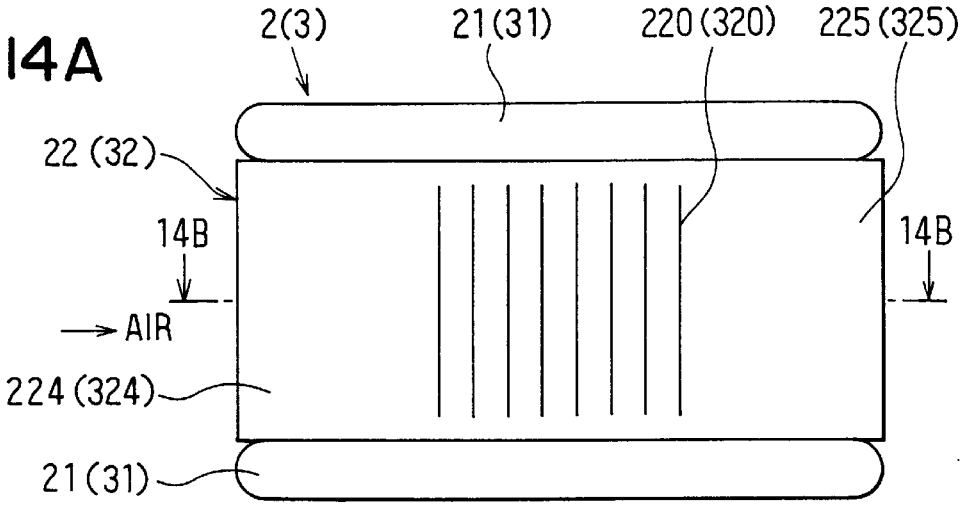
FIG. 14A is a plan view showing tubes and cooling fins according to the first comparison example of the seventh embodiment.
Figure 14B:
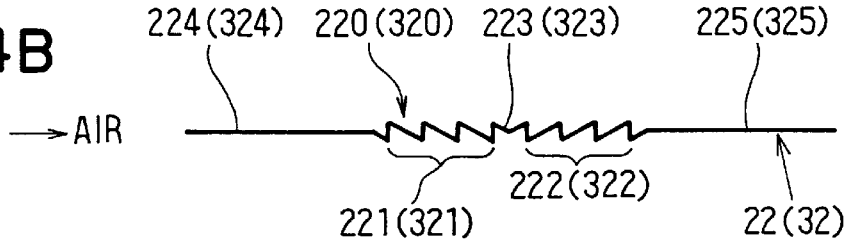
FIG. 14B is a cross sectional view taken along line 14B—14B in FIG. 14A.
Figure 15A:
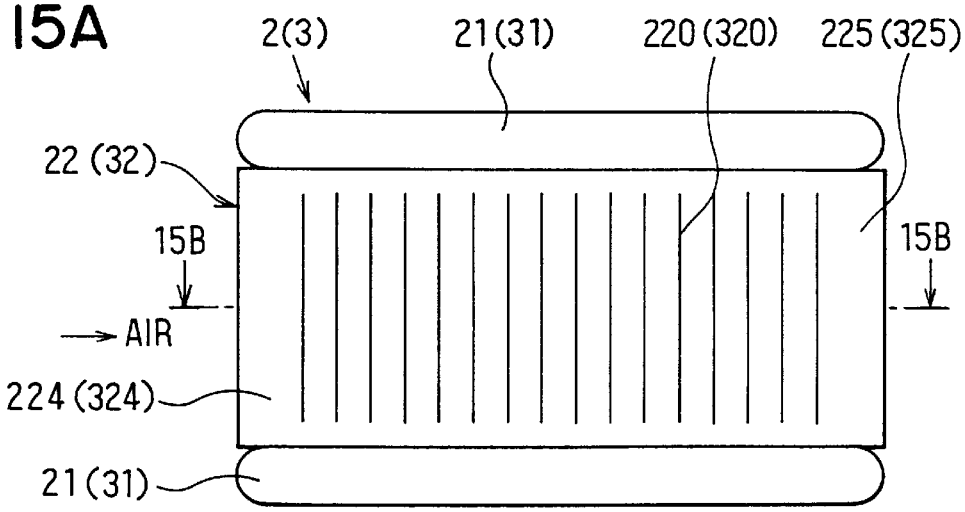
FIG. 15A is a plan view showing tubes and cooling fins according to the second comparison example of the seventh embodiment.
Figure 15B:
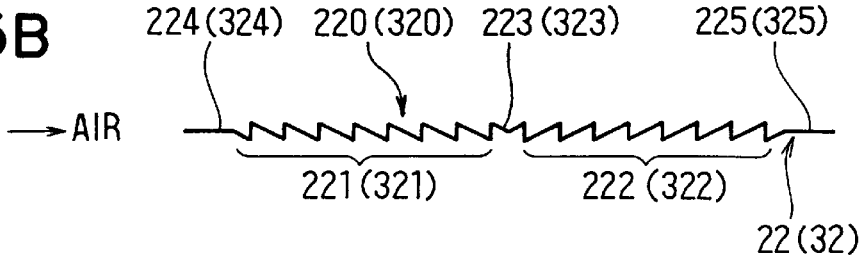
FIG. 15B is a cross sectional view taken along line 15B—15B in FIG. 15A.

FIGS. 14 and 15 show a first and a second comparison examples being compared with the seventh embodiment. The first and second comparison examples are all the same except for the number of louvers 220, 320.

Figure 16:
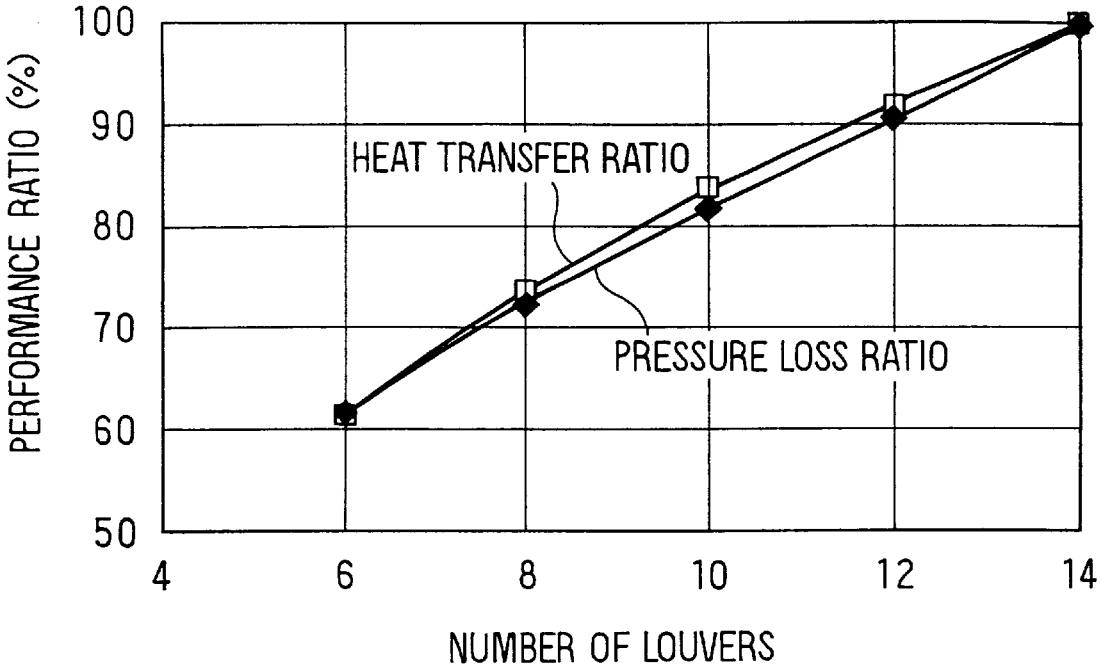
FIG. 16 is a graph showing the relations between a number of louvers and a performance ratio.

According to the experimented results and studies about the first and second comparison examples, when the number of louvers is simply decreased from both front and rear side in the air flow direction, both air pressure loss and heat transfer ratio are decreased proportionally, as shown in FIG. 16.

Figure 17:
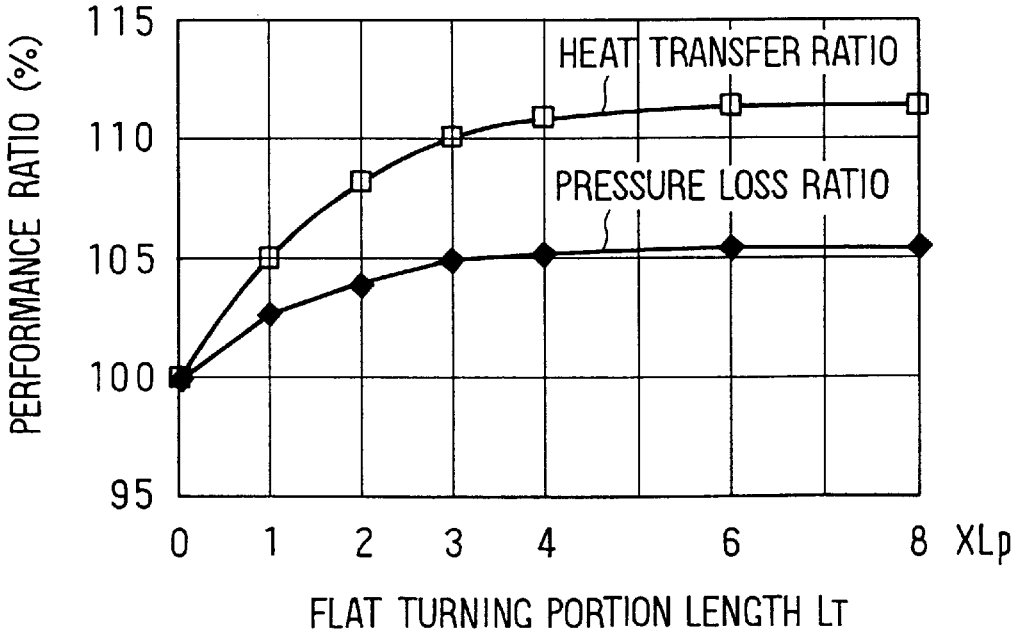
FIG. 17 is a graph showing a flat turning portion length and a performance ratio.

Further, according to the experimented results and studies about relations between the length $L_T$ of the flat turning surface 223*a*, 323*a* of the turning louver 223, 323 and the performance ratio of the core portion 2, 3, when the length $L_T$ of the flat turning surface 223*a*, 323*a* becomes large, both heat transfer ratio and pressure loss ratio of the fin increase as shown in FIG. 17. Here, FIG. 17 shows the relations between the length $L_T$ and the performance ratio of the core portion 2, 3 under the condition that the air flow speed is constant. The length $L_T$ is expressed as a multiple of the louver pitch Lp.

As is understood from FIG. 17, the heat transfer ratio and the pressure loss ratio of the fin increase as the length $L_T$ becomes large, and are saturated as the length $L_T$ is more than 3×Lp. Therefore, it is preferable to set the length $L_T$ to be three times or more as the louver pitch Lp.

The heat transfer ratio of the fin increases in accordance with that the length $L_T$ of the flat turning surface 223*a*, 323*a* becomes large because the following reason. That is, as the length $L_T$ becomes large, the flow speed of the air passing through the second louver group 222, 322 which is disposed at the air downstream side of the turning louver 223, 323 recovers. Thus, the air passes through the second louver group 222, 322 at high speed.

Accordingly, in the seventh embodiment, the length $L_T$ of the flat turning surface 223*a*, 323*a* of the turning louver 223, 323 is set to be three times or more as the louver pitch Lp.

Figure 18A:
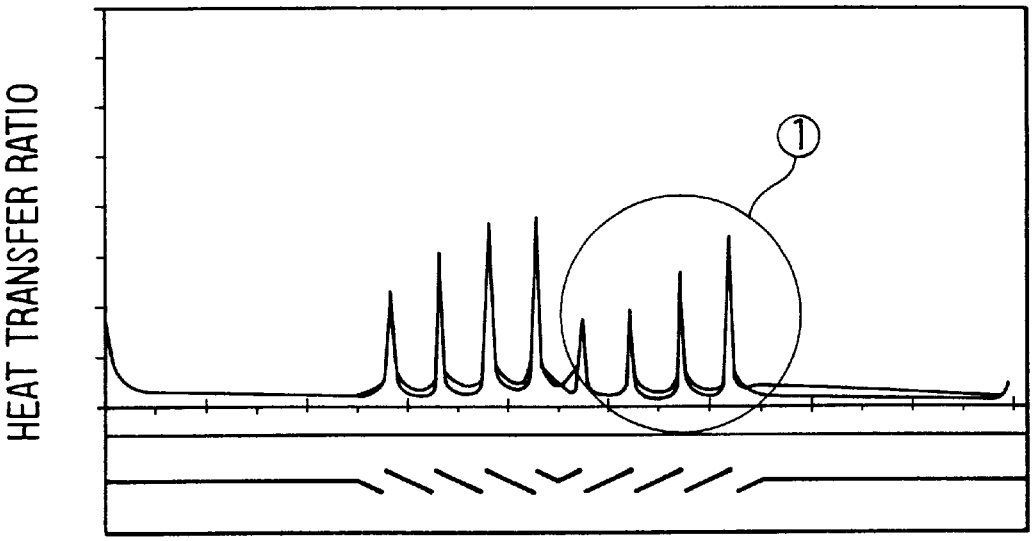
FIG. 18 is a graph showing a heat transfer ratio in accordance with a position of the cooling fin along an air flow direction.
Figure 18B:
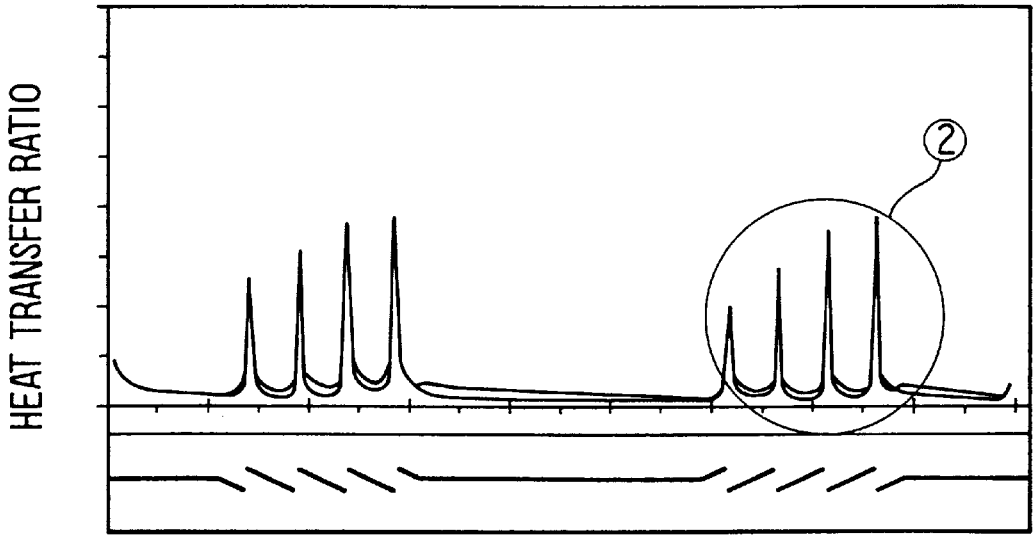

In FIG. 18A, the axis of abscissa denotes the cross sectional shape of the fin in the comparison example shown in FIG. 14B in the air flow direction. In FIG. 18B, the axis of abscissa denotes the cross sectional shape of the fin in the seventh embodiment shown in FIG. 13B in the air flow direction.

In the comparison example, the turning louver 223, 323 is formed into a V-shape, i.e., the turning louver 223, 323 has no flat turning surface. Thus, the flow speed of the air passing through the second louver group 222, 322 does not recover and is still low. Therefore, as denoted by ① in FIG. 18A, the heat transfer ratio in the second louver group 222, 322 is lower than that in the first louver group 221, 321.

Contrary to this, in the seventh embodiment, the length $L_T$ of the flat turning surface 223*a*, 323*a* is set to be 5.5 times as the louver pitch Lp. That is, the length $L_T$ is large enough to make the speed of the air passing through the second louver group 222, 322 recover. Thus, because the air passes through the second louver group 222, 322 at high speed, the heat transfer ratio in the second louver group 222, 322 is approximately the same as in the first louver group 221, 321 as denoted by ② in FIG. 18B.

According to the inventor's research and study, it is preferable that the length $L_T$ of the flat turning surface 223*a*, 323*a* in one cooling fin in which the number of louvers is smaller than that in the other cooling fin is set to be longer than the length Li of the air introducing portion 224, 324 disposed at the air upstream side of the louvers 220, 320 for making the flow speed of the air passing through the second louver group 222, 322 recover.

(Eighth Embodiment)

Figure 19A:
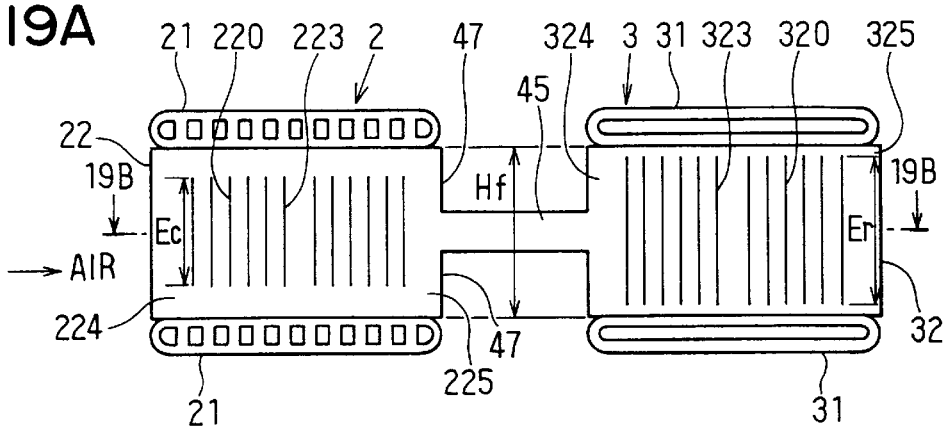
FIG. 19A is a plan view showing tubes and cooling fins according to the eighth embodiment.
Figure 19B:
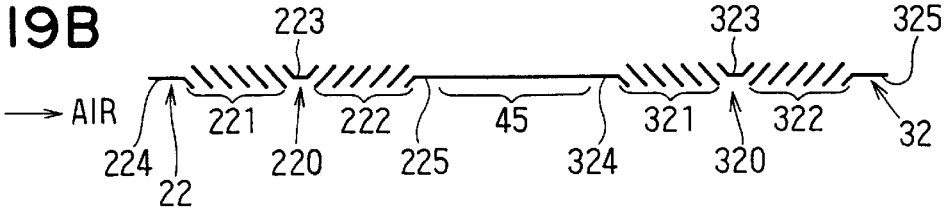
FIG. 19B is a cross sectional view taken along line 19B—19B in FIG. 19A.

According to the eighth embodiment, as shown in FIGS. 19A, 19B, a length (cut length) Ec of the condenser louver 220 and a length (cut length) Er of the radiator louver 320 are set to be different from each other. The length Ec, Er is defined as a length of the louver 220, 320 in a direction perpendicular to the air flow direction, and influences the heat transfer ratio and the air flow resistance.

That is, when the length Ec, Er of the louver 220, 320 is decreased, the heat transfer ratio and the air flow resistance are also decreased.

In the eighth embodiment, the length Ec of the condenser louver 220 is set to be shorter than the length Er of the radiator louver 320 for improving the performance of the radiator core portion 3.

Thus, though the performance of the condenser core portion 2 is decreased by shortening the length Ec of the condenser louver 220, the air resistance is decreased by shortening the length Ec of the condenser louver 220 thereby increasing the air flow amount. Therefore, the performance of the radiator core portion 3 is improved.

Here, for example, the fin height Hf of the cooling fin 22, 32 (distance between a pair of adjacent tubes) is 8 mm, the length Er of the radiator louver 320 is 7 mm, and the length Ec of the condenser louver 220 is 5 mm.

(Ninth Embodiment)

Figure 20A:
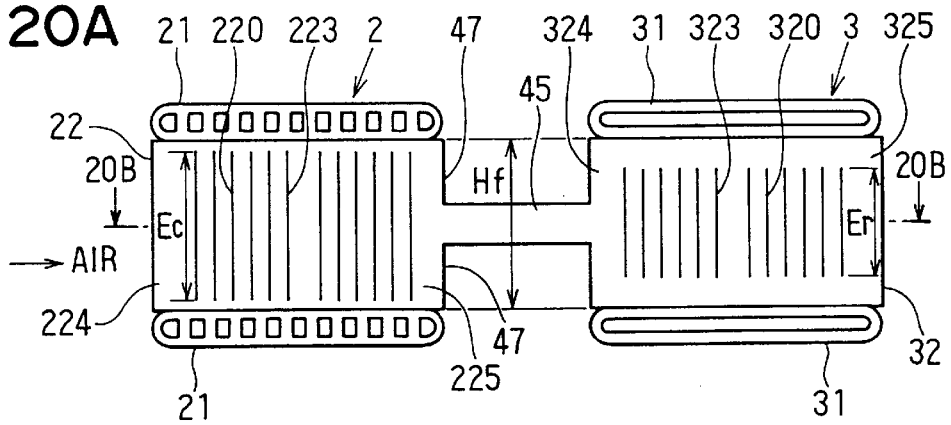
FIG. 20A is a plan view showing tubes and cooling fins according to the ninth embodiment.
Figure 20B:
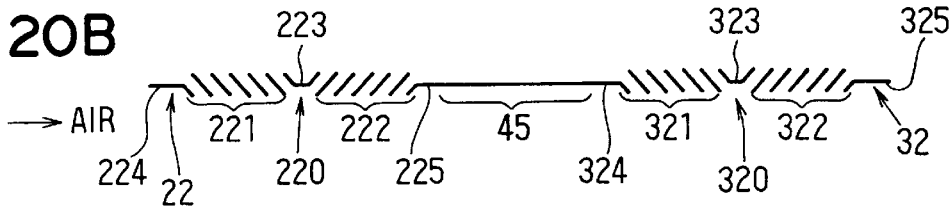
FIG. 20B is a cross sectional view taken along line 20B—20B in FIG. 20A.

According to the ninth embodiment, as shown in FIGS. 20A, 20B, the length Er of the radiator louver 320 is set to be shorter than the length Ec of the condenser louver 220 for improving the performance of the condenser core portion 2.

(Tenth Embodiment)

Figure 21A:
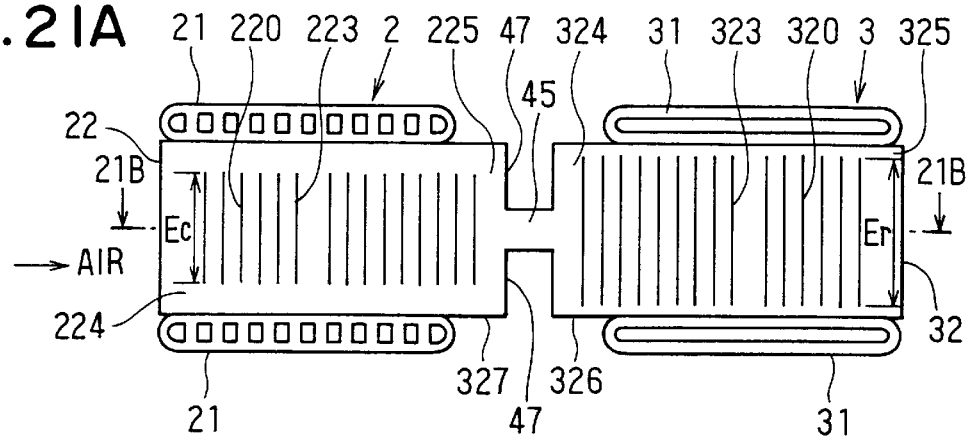
FIG. 21A is a plan view showing tubes and cooling fins according to the tenth embodiment.
Figure 21B:
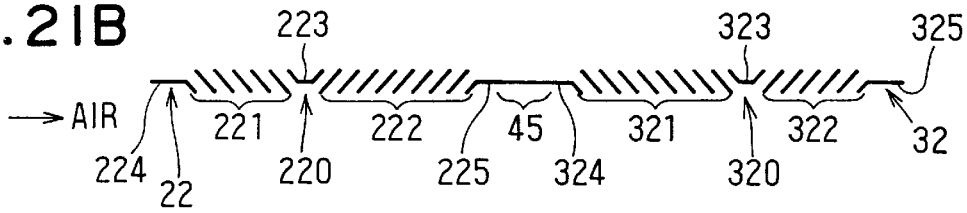
FIG. 21B is a cross sectional view taken along line 21B—12B in FIG. 21A.

According to the tenth embodiment, as shown in FIGS. 21A, 21B, the projection portion 326 described in FIG. 8A is provided at the air upstream side end of the radiator cooling fin 32, and a projection portion 327 facing the projection portion 326 is provided at the air downstream side end of the condenser cooling fin 22 also. By this, the number of condenser louvers 220 in the second louver group 222 and the number of radiator louvers 320 in the first louver group 321 are increased.

Further, the length Ec of the condenser louver 220 is set to be shorter than the length Er of the radiator louver 320.

Figure 22:
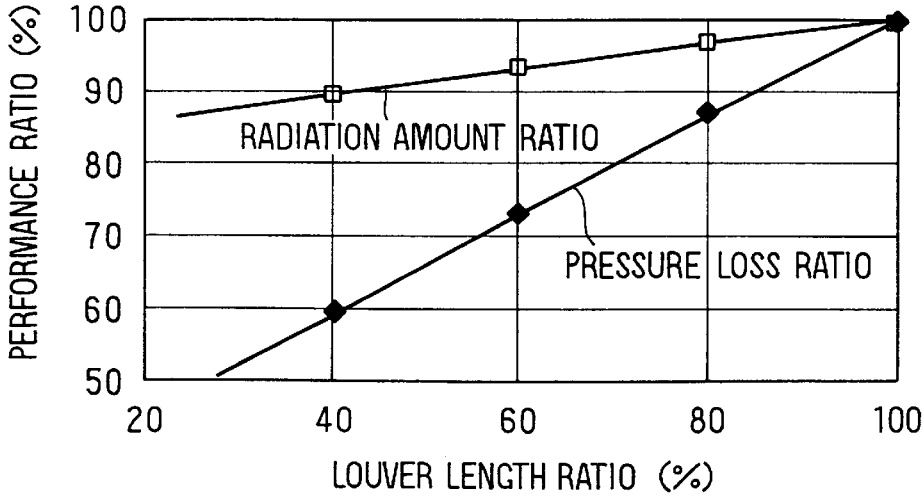
FIG. 22 is a graph showing relations between a louver cut length ratio and a performance ratio.

FIG. 22 is a graph showing relations between the length of the louver in the eighth through tenth embodiments and the performance of the core portion under the condition that the flow speed of the air passing through the core portion is constant. The louver length ratio placed on the axis of abscissa is a ratio of the louver length which is shortened intently (for example, condenser louver length Ec in the eighth embodiment) to the louver length which is defined by the fin height Hf (for example, radiator louver length Er in the eighth embodiment).

That is, the louver length ratio is defined as follows:

(Louver length which is shortened intently)/(Louver length which is defined by a fin height).

As is understood from FIG. 22, when the louver length ratio is set to be 50%, the radiation amount in the core portion in which the louver length is shorten decreases by about 10%, and the pressure loss therein decreases by about 30%. By this, pressure loss decreases by about 30%, the radiation amount in the core portion in which the louver length is defined by the fin height is improved by about 5%.

(Eleventh Embodiment)

Figure 23A:
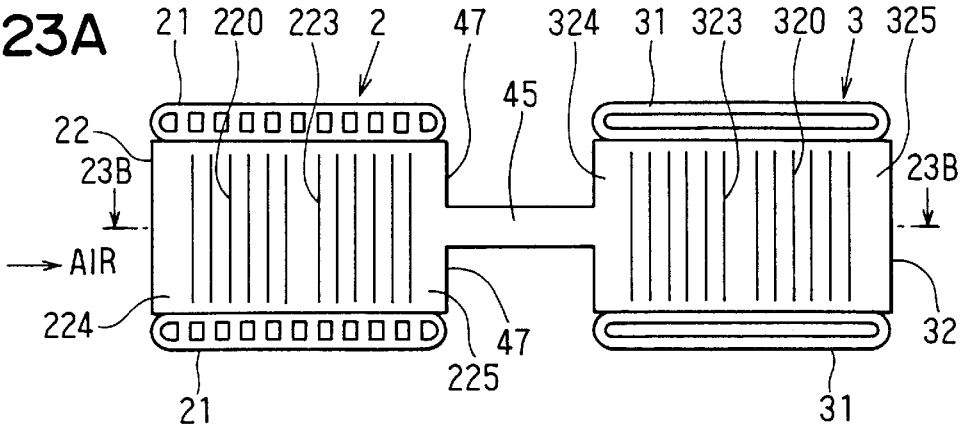
FIG. 23A is a plan view showing tubes and cooling fins according to the eleventh embodiment.
Figure 23B:
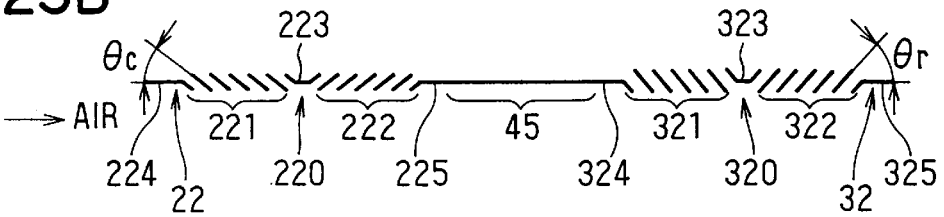
FIG. 23B is a cross sectional view taken along line 23B—23B in FIG. 23A.

According to the eleventh embodiment, as shown in FIGS. 23A, 23B, a tilt angle θc of the condenser louver 220 and a tilt angle θr of the radiator louver 320 are set to be different from each other. The tilt angles θc, θr influence the heat transfer ratio and the air flow resistance.

That is, when the tilt angle θc, θr of the louver 220, 320 is decreased, the speed of the air passing through the louvers is decreased, and the heat transfer ratio and the air flow resistance are also decreased.

In the eleventh embodiment, the tilt angle θc of the condenser louver 220 is set to be smaller than the tilt angle θr of the radiator louver 320 for improving the radiation performance of the radiator core portion 3.

Thus, though the performance of the condenser core portion 2 decreases by reducing the tilt angle θc of the condenser louver 220, the air resistance decreases by reducing the tilt angle θc of the condenser louver 220 thereby increasing the air flow amount. Therefore, the performance of the radiator core portion 3 is improved.

For example, the tilt angle θc of the condenser louver 220 is 18°, and the tilt angle θr of the radiator louver 320 is 25°.

(Twelfth Embodiment)

Figure 24A:
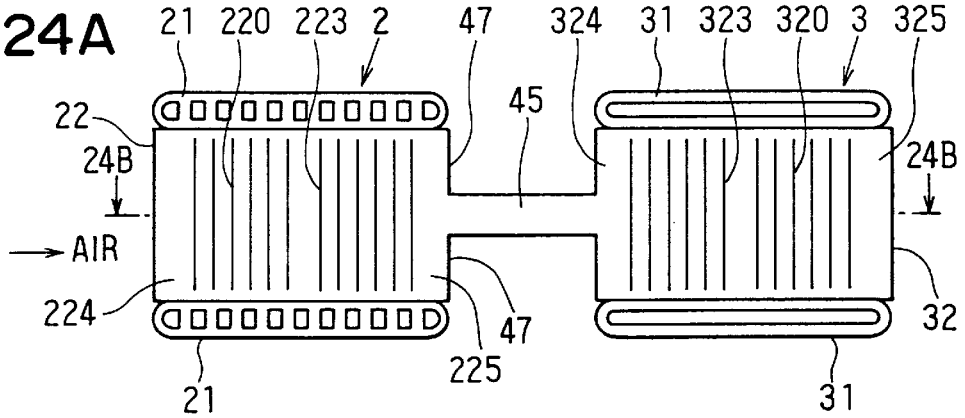
FIG. 24A is a plan view showing tubes and cooling fins according to the twelfth embodiment.
Figure 24B:
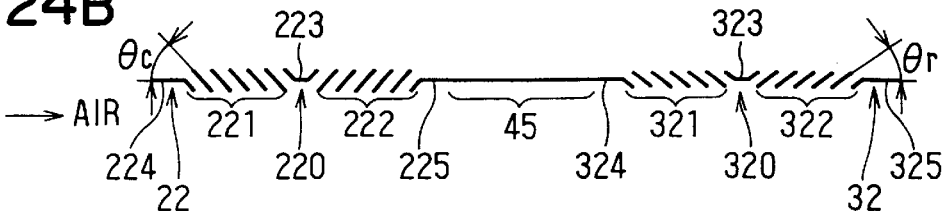
FIG. 24B is a cross sectional view taken along line 24B—24B in FIG. 24A.

According to the twelfth embodiment, as shown in FIGS. 24A, 24B, the tilt angle θr of the radiator louver 320 is set to be smaller than the tilt angle θc of the condenser louver 220 for improving the performance of the condenser core portion 2.

(Thirteenth Embodiment)

Figure 25A:
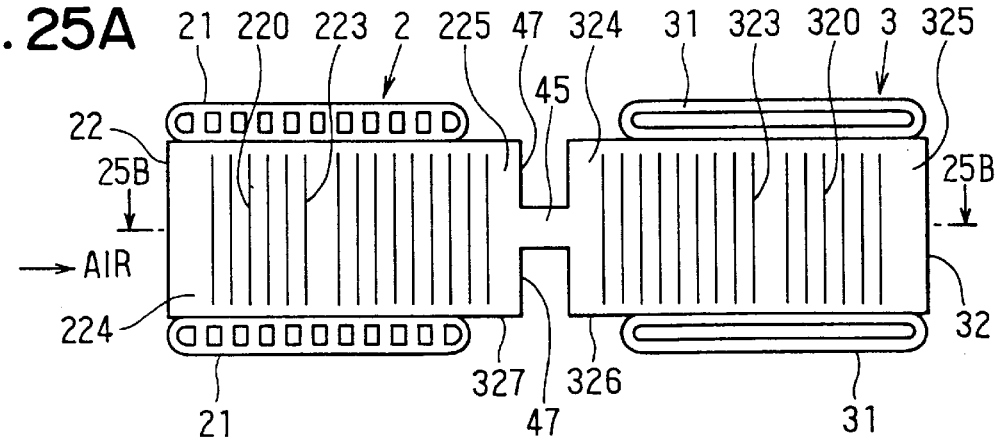
FIG. 25A is a plan view showing tubes and cooling fins according to the thirteenth embodiment.
Figure 25B:
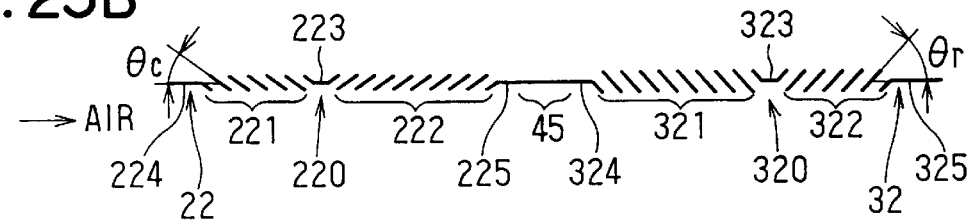
FIG. 25B is a cross sectional view taken along line 25B—25B in FIG. 25A.

According to the thirteenth embodiment, as shown in FIGS. 25A, 25B, the projection portion 326 described in FIG. 21 is provided at the air upstream side end of the radiator cooling fin 32, and a projection portion 327 facing the projection portion 326 is provided at the air downstream side end of condenser cooling fin 22 also. By this, the number of condenser louvers 220 in the second louver group 222 and the number of radiator louvers 321 in the first louver group 322 are increased.

Further, the tilt angle θc of the condenser louver 220 is set to be larger than the tilt angle θr of the radiator louver 320.

Figure 26:
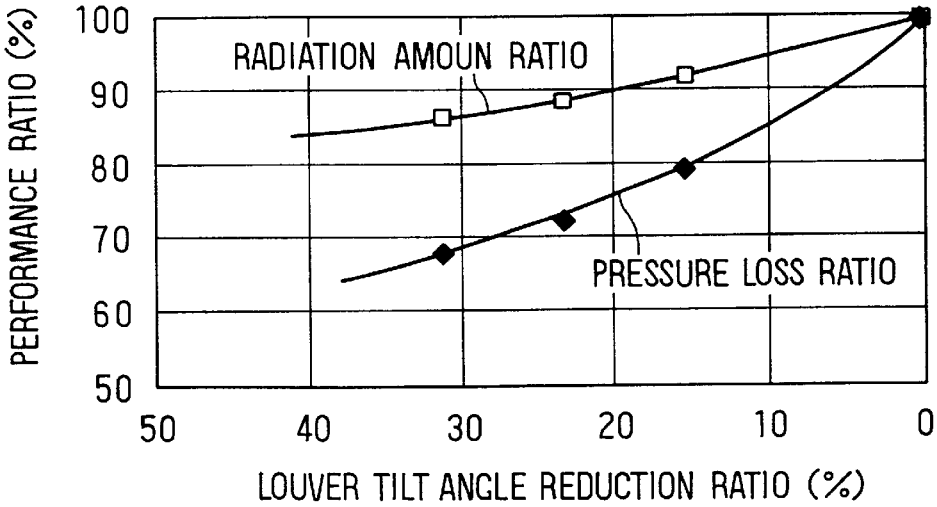
FIG. 26 is a graph showing relations between louver a tilt angle reduction ratio and a performance ratio.

FIG. 26 is a graph showing relations between the tilted angle of the louver in the eleventh through thirteenth embodiments and the performance of the core portion under the condition that the flow speed of the air passing through the core portion is constant.

Here, a louver tilt angle reduction ratio which is placed on the axis of abscissa is defined as a ratio of the tile-angle reduced intently to the common tilt-angle for attaining a high heat transfer ratio.

That is, the louver tilt angle reduction ratio is defined as follows:

(tile-angle reduced intently)/(common tilt-angle for attaining a high heat transfer ratio)×100.

As is understood from FIG. 26, for example, when the tilt angle reduction ratio is set to be 20%, the radiation amount in the core portion in which the tilt-angle is reduced decreases by about 10%, and the pressure loss therein decreases by about 25%. By this decreasing pressure loss decreasing by about 25%, the radiation amount in the core portion in which the tile-angle of the louver is the common angle for attaining the high heat transfer ratio is improved about 4%.

In the above described embodiments, the present invention is applied to the heat exchanger in which the condenser core portion 2 and the radiator core portion 3 are integrated. However, it is to be noted that the present invention can be applied to various heat exchangers in which two heat exchanging core portions, to carry out heat exchanges between two kinds of fluid and the air, are integrated.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger comprising:

a first core portion to carry out a heat exchange between a first fluid and an external fluid, said first core portion including a plurality of first tubes through which the first fluid flows and a first cooling fin having plural louvers disposed between each pair of adjacent first tubes; and a second core portion disposed to carry out a heat exchange between a second fluid and the external fluid, said second core portion including a plurality of second tubes through which the second fluid flows and a second cooling fin having plural louvers disposed between each pair of adjacent second tubes; wherein said first core portion and said second core portion are disposed in parallel with a predetermined clearance therebetween, said first cooling fin and said second cooling fin are integrated by a connecting portion, and said first core portion, having a first required radiation amount, defines a first ratio of the number of said louvers to a width of said first cooling fin in an external fluid flow direction, said second core portion, having a second required radiation amount, defines a second ratio of the number of said louvers to a width of said second cooling fin in the external fluid flow direction, said first required radiation amount and said first ratio being smaller than said second required radiation amount and said second ratio, respectively, wherein the number of louvers in said first core portion is decreased by 30% or more relative to the number of louvers in the second core portion.

2. A heat exchanger according to claim 1, wherein said first core portion is a condenser core portion for condensing a refrigerant of a condenser for forming a refrigeration cycle, said second core portion is a radiator core portion for cooling an engine coolant of an automotive engine, said external fluid is cooling air for condensing the refrigerant and cooling the engine coolant, and said condenser core portion is disposed at an air upstream side of said radiator core portion.

3. A heat exchanger according to claim 1, wherein, said first cooling fin has a plurality of folded portions, said second cooling fin has a plurality of folded portions, and at least two of said folded portions of said first and second cooling fins are formed between adjacent connecting portions.

4. A heat exchanger comprising:

a first core portion to carry out a heat exchange between a first fluid and an external fluid, said first core portion including a plurality of first tubes through which the first fluid flows and a first cooling fin having plural louvers disposed between each pair of adjacent first tubes; and a second core portion disposed to carry out a heat exchange between a second fluid and the external fluid, said second core portion including a plurality of second tubes through which the second fluid flows and a second cooling fin having plural louvers disposed between each pair of adjacent second tubes; wherein said first core portion and said second core portion are disposed in parallel with a predetermined clearance therebetween, said first cooling fin and said second cooling fin are integrated by a connecting portion, said first core portion, having a first required radiation amount, defines a first ratio of the number of said louvers to a width of said first cooling fin in an external fluid flow direction, said second core portion, having a second required radiation amount, defines a second ratio of the number of said louvers to a width of said second cooling fin in the external fluid flow direction, said first required radiation amount and said first ratio being smaller than said second required radiation amount and said second ratio, respectively, wherein the number of louvers in said first core portion is decreased by 30% or more relative to the number of louvers in said second core portion, said first core portion is a condenser core portion for condensing a refrigerant of a condenser for forming a refrigeration cycle, said second core portion is a radiator core portion for cooling an engine coolant of an automotive engine, said external fluid is cooling air for condensing the refrigerant and cooling the engine coolant, and said condenser core portion is disposed at an air upstream side of said radiator core portion.

5. A heat exchanger according to claim 4, wherein, said first cooling fin has a plurality of folded portions, said second cooling fin has a plurality of folded portions, and at least two of said folded portions of said first and second cooling fins are formed between adjacent connecting portions.

* * * * *